US011763776B1

(12) United States Patent
Su et al.

(10) Patent No.: US 11,763,776 B1
(45) Date of Patent: Sep. 19, 2023

(54) DISPLAY DEVICE, PROCESSOR, AND IMAGE PROCESSING METHOD

(71) Applicant: NOVATEK Microelectronics Corp., Hsinchu (TW)

(72) Inventors: Shang-Yu Su, Hsinchu County (TW); Feng-Ting Pai, Hsinchu (TW)

(73) Assignee: NOVATEK Microelectronics Corp., Hsinchu (TW)

( * ) Notice: Subject to any disclaimer, the term of this patent is extended or adjusted under 35 U.S.C. 154(b) by 0 days.

(21) Appl. No.: 17/817,001

(22) Filed: Aug. 2, 2022

(51) Int. Cl.
*G09G 5/06* (2006.01)

(52) U.S. Cl.
CPC ..... *G09G 5/06* (2013.01); *G09G 2320/045* (2013.01); *G09G 2370/16* (2013.01)

(58) Field of Classification Search
CPC ..... G09G 2320/045; G09G 2320/043; G09G 2320/046
See application file for complete search history.

(56) References Cited

U.S. PATENT DOCUMENTS 9,524,676 B2 12/2016 Bi et al.
9,997,104 B2 6/2018 Zhang et al.
2017/0206819 A1* 7/2017 Pyo ..... G09G 3/3225
2020/0058251 A1* 2/2020 Lee ..... G09G 3/3607
2022/0157237 A1 5/2022 Tang et al.
2023/0101641 A1* 3/2023 Lim ..... G09G 3/3291 345/204

FOREIGN PATENT DOCUMENTS

TW 202147277 A 12/2021

* cited by examiner

*Primary Examiner* — Kevin M Nguyen
(74) *Attorney, Agent, or Firm* — CKC & Partners Co., LLC

(57) ABSTRACT

A display device includes a display panel and a processor. The processor is coupled to the display panel. The processor is configured to generate first output data according to first input data and a first compensation value, generate a stress reduction value and a compensation reduction value according to the first input data, calculate a final stress value according to the first output data, at least one first operating factor, and the stress reduction value, calculate a second compensation value according to the final stress value and the compensation reduction value, and output second output data according to second input data, the second compensation value, and at least one second operating factor. The display panel receives the second output data to display according to the second output data.

20 Claims, 6 Drawing Sheets

SR

| | | |
|---|---|---|
| -6 | -3 | -7 |
| 0 | -6 | -6 |
| -2 | -4 | -4 |
| -7 | -4 | -6 |
| -7 | -3 | -2 |
| -5 | -5 | -4 |

CR

| | | |
|---|---|---|
| -3 | -1 | -3 |
| 0 | -3 | -3 |
| -1 | -2 | -2 |
| -3 | -2 | -3 |
| -3 | -1 | -1 |
| -2 | -2 | -2 |

DOT

| | | |
|---|---|---|
| 214 | 145 | 255 |
| 0 | 233 | 214 |
| 128 | 177 | 177 |
| 255 | 177 | 233 |
| 255 | 145 | 128 |
| 192 | 192 | 177 |

FIG. 6

DISPLAY DEVICE, PROCESSOR, AND IMAGE PROCESSING METHOD

BACKGROUND

Technical Field

The present disclosure relates to compensation technology. More particularly, the present disclosure relates to a display device, a processor, and an image processing method.

Description of Related Art

With developments of technology, more and more electronic devices are equipped with display panels. The attenuation of different sub-pixels may be different due to characteristic of the sub-pixels, illumination time of the sub-pixels, or other factors, resulting in uneven brightness or color cast.

SUMMARY

Some aspects of the present disclosure are to provide a display device. The display device includes a display panel and a processor. The processor is coupled to the display panel. The processor is configured to generate first output data according to first input data and a first compensation value, generate a stress reduction value and a compensation reduction value according to the first input data, calculate a final stress value according to the first output data, at least one first operating factor, and the stress reduction value, calculate a second compensation value according to the final stress value and the compensation reduction value, and output second output data according to second input data, the second compensation value, and at least one second operating factor. The display panel receives the second output data to display according to the second output data.

Some aspects of the present disclosure are to provide a processor. The processor is coupled to a display panel. The processor is configured to generate first output data according to first input data and a first compensation value, generate a stress reduction value and a compensation reduction value according to the first input data, calculate a final stress value according to the first output data, at least one first operating factor, and the stress reduction value, calculate a second compensation value according to the final stress value and the compensation reduction value, and output second output data according to second input data, the second compensation value, and at least one second operating factor for the display panel to display according to the second output data.

Some aspects of the present disclosure are to provide an image processing method. The image processing method includes following operations: generating, by a processor, first output data according to first input data and a first compensation value; generating, by the processor, a stress reduction value and a compensation reduction value according to the first input data; calculating, by the processor, a final stress value according to the first output data, at least one first operating factor, and the stress reduction value; calculating, by the processor, a second compensation value according to the final stress value and the compensation reduction value; and outputting, by the processor, second output data according to second input data, the second compensation value, and the at least one second operating factor for a display panel to display.

BRIEF DESCRIPTION OF THE DRAWINGS

The disclosure can be more fully understood by reading the following detailed description of the embodiment, with reference made to the accompanying drawings as follows:

FIG. 6 is a schematic diagram illustrating converting the display off time into a stress reduction value or a compensation reduction value according to some embodiments of the present disclosure.

DETAILED DESCRIPTION

In the present disclosure, "connected" or "coupled" may refer to "electrically connected" or "electrically coupled." "Connected" or "coupled" may also refer to operations or actions between two or more elements.

Figure 1:
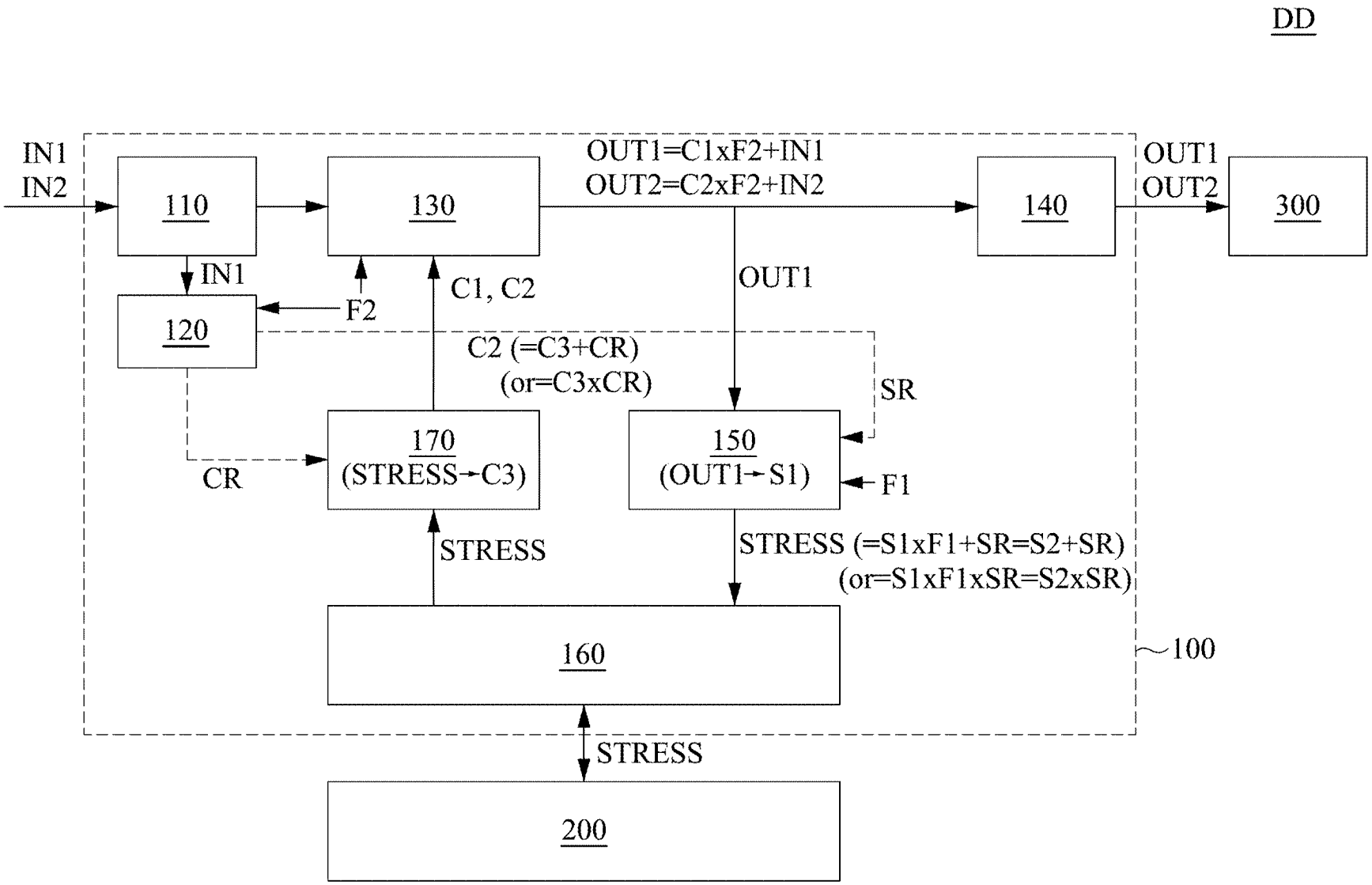
FIG. 1 is a schematic diagram illustrating a display device according to some embodiments of the present disclosure.

Reference is made to FIG. 1. FIG. 1 is a schematic diagram illustrating a display device DD according to some embodiments of the present disclosure.

As illustrated in FIG. 1, the display device DD includes a processor 100, a memory 200, and a display panel 300. The processor 100 is coupled to the memory 200 and the display panel 300. The processor 100 can be implemented by a central processing unit (CPU), a micro controller unit (MCU), or other circuits with similar functions. The memory 200 can be implemented by a flash or other non-volatile memories. The display panel 300 can be an OLED panel, a LCD panel, a LED panel, a mini LED panel, a micro LED panel, an electronic paper, a plasma display panel, or other display panels.

As illustrated in FIG. 1, the processor 100 includes an input unit 110, a reduction unit 120, a compensation unit 130, an output unit 140, a stress value generating unit 150, a storage unit 160, and a stress-to-compensation unit 170.

The input unit 110, the reduction unit 120, the compensation unit 130, the output unit 140, the stress value generating unit 150, and the stress-to-compensation unit 170 can be implemented by Application Specific Integrated Circuits (ASICs) or be implemented by performing one or more computer programs stored in a non-transitory computer readable storage medium by the processor 100. The storage unit 160 can be implemented by a Static Random Access Memory (SRAM).

Figure 2:
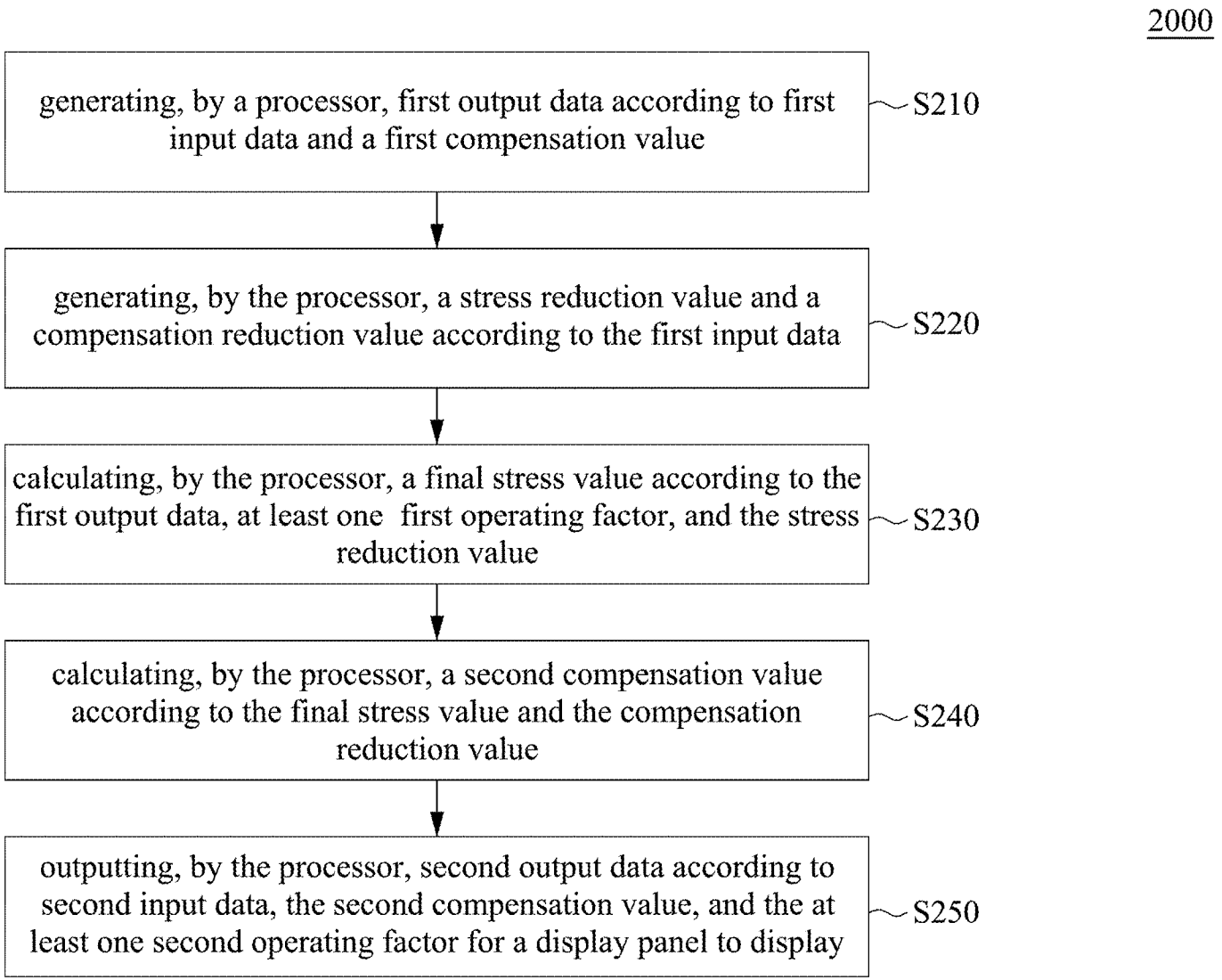
FIG. 2 is a flow diagram illustrating an image processing method according to some embodiments of the present disclosure.

Reference is made to FIG. 2. FIG. 2 is a flow diagram illustrating an image processing method 2000 according to some embodiments of the present disclosure.

As illustrated in FIG. 2, the image processing method 2000 includes operations S210, S220, S230, S240, and S250. In some embodiments, the image processing method 2000 can be applied to the display device DD in FIG. 1, but the present disclosure is not limited thereto. For better understanding, the image processing method 2000 is described in following paragraphs with reference to FIG. 1.

In operation S210, the processor 210 generates output data OUT1 according to input data IN1 and a compensation value C1. For example, the input unit 110 receives the input data IN1 of an image. The image can be a static image or a dynamic image. The input data IN1 can be various data (e.g., gamma code) or various values of the image. Then, the compensation unit 130 multiples the compensation value C1 from the stress-to-compensation unit 170 with at least one factor F2, and adds the product and the input data IN1 to generate the output data OUT1. The at least one operating factor F2 can be associated with a display brightness value (DBV), a driving frame rate, a temperature, an image loading value, or other parameters of the display panel 300. In some embodiments, the compensation unit 130 multiples the compensation value C1 with a plurality of operating factors F2, and adds the product and the input data IN1 to generate the output data OUT1. The display panel 300 receives the output data OUT1 to display according to the output data OUT1.

In operation S220, the processor 210 generates a stress reduction value SR and a compensation reduction value CR according to the input data IN1. The details of how to generate the stress reduction value SR and the compensation reduction value CR according to the input data IN1 are described in following paragraphs with reference FIG. 3 to FIG. 6. When a region is not always in a display-on-state during a time interval, the stress reduction value SR and the compensation reduction value CR corresponding to the region can be a negative value or a positive value less than 1. When a region is always in a display-on-state during a time interval, the stress reduction value SR and the compensation reduction value CR corresponding to the region can be 0 or 1.

In operation S230, the processor 210 calculates a final stress value STRESS according to the output data OUT1, at least one operating factors F1, and the stress reduction value SR. For example, the stress value generating unit 150 converts the output data OUT1 into a stress value S1 according to a look-up table. Then, the stress value generating unit 150 multiples the stress value S1 with the at least one operating factor F1 to generate a stress value S2, and generates the final stress value STRESS according to the stress value S2 and the stress reduction value SR. The at least one operating factor F1 can be associated with the DBV, the driving frame rate, the temperature, the image loading value, or other parameters of the display panel 300. In some embodiments, the stress value generating unit 150 multiples the stress value S1 with a plurality of operating factors F1 to generate the stress value S2.

As described above, when a region is not always in a display-on-state during a time interval, the stress reduction value SR can be a negative value or a positive value less than 1. When the stress reduction value SR is a negative value, the stress value generating unit 150 adds the stress value S2 and the stress reduction value SR to generate the final stress value STRESS. When stress reduction value SR is a positive value less than 1, the stress value generating unit 150 multiples the stress value S2 with the stress reduction value SR to generate the final stress value STRESS. When a region is always in a display-on-state during a time interval, the stress reduction value SR corresponding to the region can be 0 or 1. When the stress reduction value SR is 0, the stress value generating unit 150 adds the stress value S2 and the stress reduction value SR to generate the final stress value STRESS. When stress reduction value SR is 1, the stress value generating unit 150 multiples the stress value S2 with the stress reduction value SR to generate the final stress value STRESS. In other words, the final stress value STRESS is less than or equal to the stress value S2. Then, the final stress value STRESS is stored and accumulated in the storage unit 160.

The storage unit 160 can store the final stress value STRESS in to the memory 200. As describe above, the memory 200 can be implemented by the non-volatile memory. The storage unit 160 can read the data or the value stored in the memory 200 after the display device DD or the processor 100 is reboot.

In operation S240, the processor 100 calculates a compensation value C2 according to the final stress value STREE and the compensation reduction value CR. For example, the stress-to-compensation unit 170 converts the final stress value STREE into a compensation value C3 according to a look-up table. Then, the stress-to-compensation unit 170 generates the compensation value C2 according to the compensation value C3 and compensation reduction value CR.

As described above, when a region is not always in a display-on-state during a time interval, the compensation reduction value CR can be a negative value or a positive value less than 1. When the compensation reduction value CR is a negative value, the stress-to-compensation unit 170 adds the compensation value C3 and the compensation reduction value CR to generate the compensation value C2. When compensation reduction value CR is a positive value less than 1, the stress-to-compensation unit 170 multiples the compensation value C3 with the compensation reduction value CR to generate the compensation value C2. When a region is always in a display-on-state during a time interval, the compensation reduction value CR corresponding to the region can be 0 or 1. When the compensation reduction value CR is 0, the stress-to-compensation unit 170 adds the compensation value C3 and the compensation reduction value CR to generate the compensation value C2. When the compensation reduction value CR is 1, the stress-to-compensation unit 170 multiples the compensation value C3 with the compensation reduction value CR to generate the compensation value C2. In other words, the compensation value C2 is less than or equal to the compensation value C3. Then, the stress-to-compensation unit 170 outputs the compensation value C2 to the compensation unit 130.

In operation S250, the processor 100 outputs output data OUT2 according to input data IN2, the compensation value C2, and the at least one operating factor F2 for the display panel 300 to display. For example, the input unit 110 receives the input data IN2. The input data IN2 can be a next frame, but the present disclosure is not limited thereto. Then, the compensation unit 130 multiples the compensation value C2 with at least one factor F2, and adds the product and the input data IN2 to generate the output data OUT2. The display panel 300 receives the output data OUT2 to display according to the output data OUT2.

As described above, the details of how to generate the stress reduction value SR and the compensation reduction value CR according to the input data IN1 are described in following paragraphs with reference FIG. 3 to FIG. 6.

Figure 3:
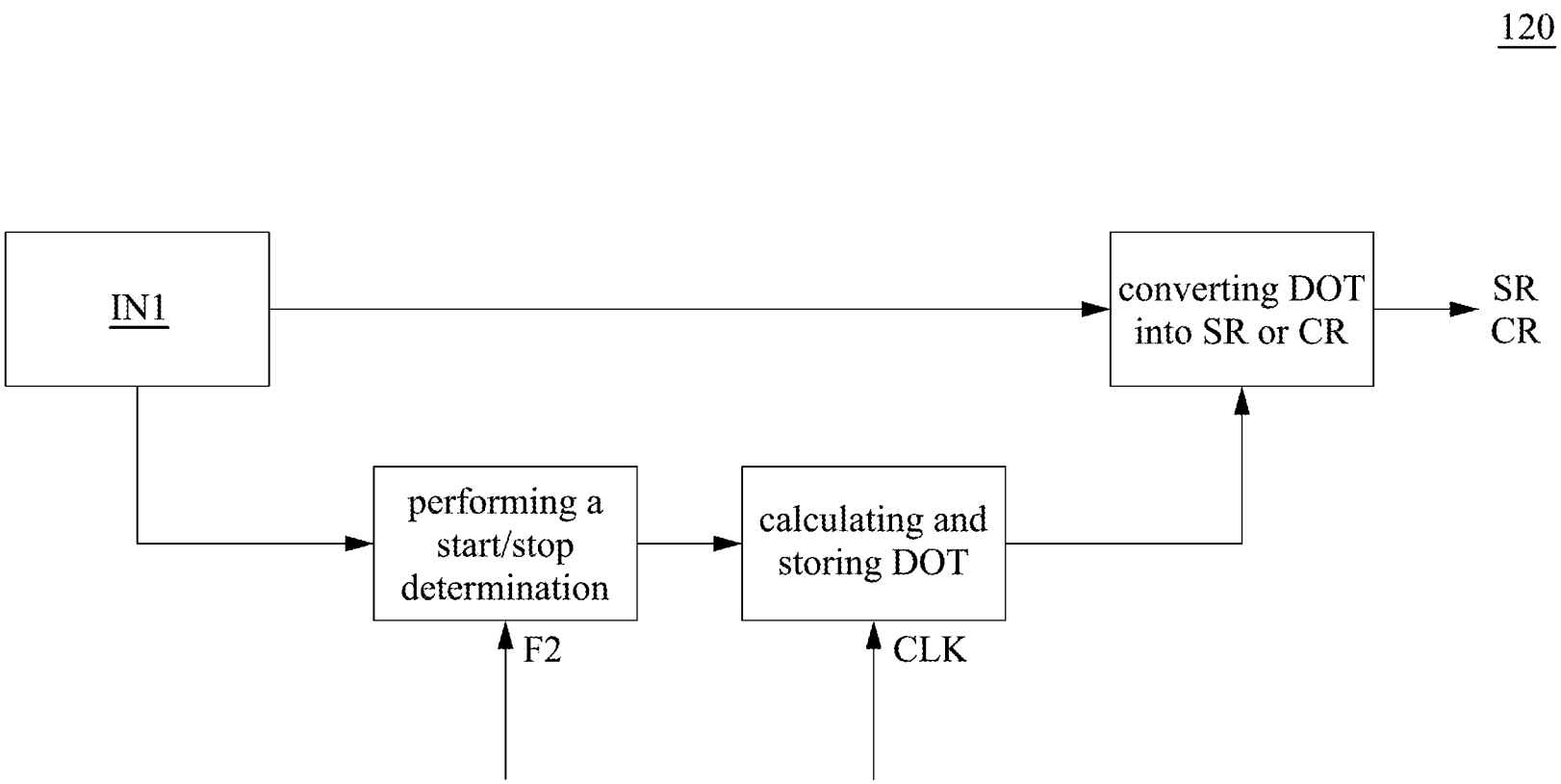
FIG. 3 is a schematic diagram illustrating operations of a reduction unit according to some embodiments of the present disclosure.

Reference is made to FIG. 3. FIG. 3 is a schematic diagram illustrating operations of the reduction unit 120 according to some embodiments of the present disclosure.

Figure 4:
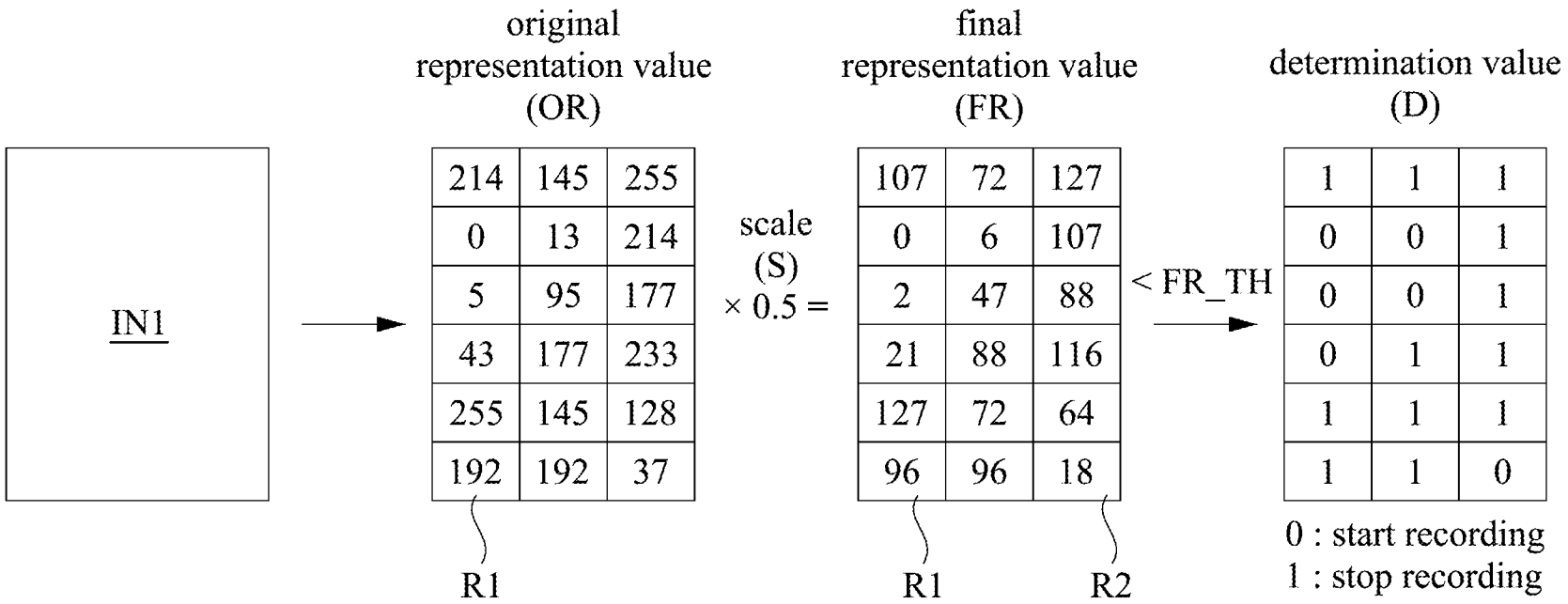
FIG. 4 is a schematic diagram illustrating performing a start/stop determination according to some embodiments of the present disclosure.

As illustrated in FIG. 3, the reduction unit 120 receives the input data IN1. Then, the reduction unit 120 performs a start/stop determination according to the input data IN1 and the at least one factor F2 to generate a start value. Reference is made to FIG. 4. FIG. 4 is a schematic diagram illustrating performing a start/stop determination according to some embodiments of the present disclosure.

As illustrated in FIG. 4, the input data IN1 is divided into one or more regions. Each region includes one sub-pixels, a line of sub-pixels with the same starting voltage range, or a block of sub-pixels with the same starting voltage range. For example, red sub-pixels have a first starting voltage range, green sub-pixels have a second starting voltage range, and blue sub-pixels have a third starting voltage range. Then, the reduction unit 120 converts the input data IN1 of one region into an original representation value OR of the region. The original representation value OR can be a maximum value, a minimum value, or an average value of gray level values, gamma codes, saturation values, hue values, brightness values, voltages, currents of the sub-pixels with the same starting voltage range in the region. For example, the original representation value OR of the region R1 is 192, and 192 is an average value of the gray level values of the red sub-pixels in the region R1. Other regions and other sub-pixels with the same starting voltage range have similar operations, and they are not described herein again.

Then, the reduction unit 120 multiplies the original representation value OR of the region with a scale S to generate a final representation value FR. For example, the reduction unit 120 multiplies 192 (the original representation value OR of the region R1) with 0.5 (the scale S) to acquire 96 (the final representation value FR of the region R1). In some embodiments, the scale S can be determined by multiplying a plurality of sub-scales. These sub-scales can be acquired by converting the aforementioned operating factors F2 (e.g., the DBV, the driving frame rate, the temperature, the image loading value, or other parameters of the display panel 300) based on converting curves respectively.

Then, the reduction unit 120 sets a determination value D of the region to be a start value when the final representation value FR is less than a threshold value FR TH. It is assumed that the threshold value FR TH is 50. As illustrated in FIG. 4, the final representation value FR of the region R2 is less than 50, and thus the determination value D of a region R2 is the start value 0. The start value 0 represents that the region R2 is in a display-off-state (e.g., the sub-pixels in the region R2 are turned off, in a dark state, or in a light-load state), and the reduction unit 120 starts recording display off time (DOT). On the contrary, the final representation value FR of the region R1 is not less than 50, and thus the determination value D of the region R1 is set to be a stop value 1. The stop value 1 represents that the region R1 is in a display-on-state (e.g., the sub-pixels in the region R1 are turned on, in a bright state, or in a heavy-load state), and the reduction unit 120 stops recording the display off time DOT.

Figure 5:
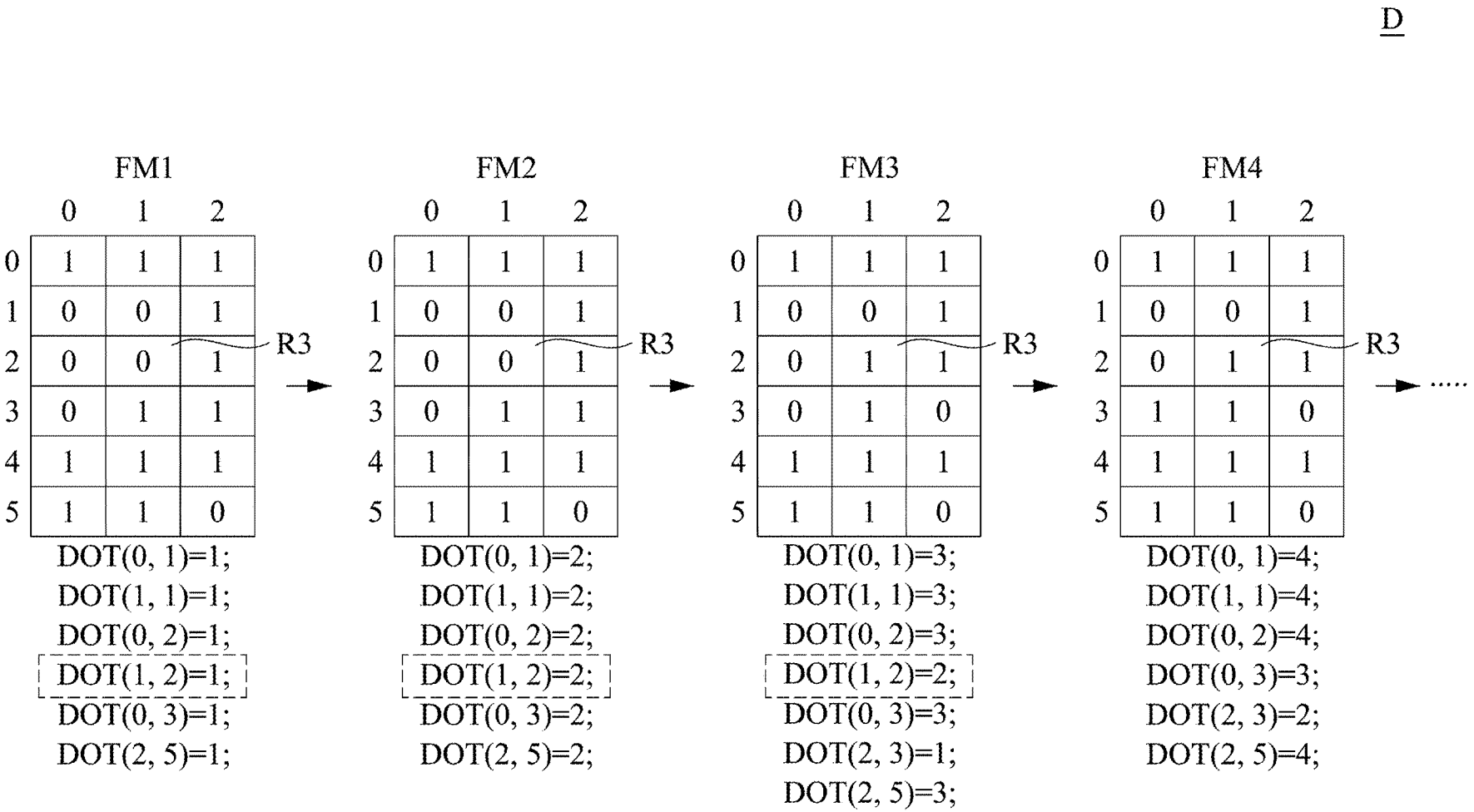
FIG. 5 is a schematic diagram illustrating calculating display off time according to some embodiments of the present disclosure.

Reference is made to FIG. 3 again. The reduction unit 120 calculates and stores the aforementioned display off time DOT according to a clock signal CLK. Reference is made to FIG. 5. FIG. 5 is a schematic diagram illustrating calculating the display off time DOT according to some embodiments of the present disclosure. As illustrated in FIG. 5, the operations of the setting the determination value D can be performed once during every frame (e.g., the clock signal CLK corresponding to one frame). Taking a region R3 as an example, when the determination value D of the region R3 is kept at the start value 0 in the first frame FM1 and the second frame FM2, but the determination value D of the region R3 is turned to be the stop value 1 in the third frame FM3 and the fourth frame FM4. Thus, the display off time DOT of the region R3 is recorded to be 2 (e.g., the first frame FM1 and the second frame FM2). It is noted that the operations of setting the determination value D and calculating the display off time DOT are not limited to the frame count. In some other embodiments, these operations can be performed once during every second, every minute, every hour, or other time units (e.g., the clock signal CLK corresponding to one second, one minute, one hour, or one other time unit).

In some embodiments, the display off time DOT can be stored in a storage circuit which can access the processor 100 or can be accessed by the processor 100. When the processor 100 is turned off, the storage circuit can store the display off time DOT. When the processor 100 is turned on, the display off time DOT is transmitted to a rear module or a rear circuit to perform following conversion operations (e.g., shown in FIG. 6).

Reference is made to FIG. 3 again. The reduction unit 120 performs conversion operations according to at least one look-up table. Reference is made to FIG. 6. FIG. 6 is a schematic diagram illustrating converting the display off time DOT into the stress reduction value SR or the compensation reduction value CR according to some embodiments of the present disclosure. As illustrated in FIG. 6, the reduction unit 120 can convert the display off time DOT into the stress reduction value SR according one look-up table (corresponding to one conversion curve), and convert the display off time DOT into the compensation reduction value CR according another look-up table (corresponding to another conversion curve). Sub-pixels with different starting voltage ranges (e.g., red sub-pixels, green sub-pixels, blue sub-pixels are with different starting voltage ranges respectively) correspond to different conversion curves. In some embodiments, the look-up tables can be established according to an operation mode. For example, a first operation mode is used to compensate brightness values of regions to original brightness values of the regions, a second operation mode is used to compensate brightness values of regions to be aligned with the brightness value corresponding to a smallest stress value (the brightness value corresponding to the smallest stress value is not compensated), and a third operation mode is used to compensate brightness values of regions to be aligned with the brightness value corresponding to a largest stress value (the brightness value corresponding to the largest stress value is not compensated).

In practical applications, when the sub-pixels display a static image or a dynamic image after displaying a period of time, the brightness of the sub-pixels will decay. However, the degradation degrees of the sub-pixels are different since the sub-pixels have different characteristic (e.g., different manufacturing process or different material), the sub-pixels are located at different positions (e.g., different temperatures or different humidity), or the sub-pixels have different turn-on time. The different degradation degrees cause uneven brightness or color cast during displaying subsequent image.

In some related approaches, some compensation methods (e.g., burn-in compensation method) are developed to solve the aforementioned problem. However, these compensation methods do not consider the display off time of the sub-pixels. In general, after the sub-pixels are turned on again after the display off time, the decayed brightness of the sub-pixels increases a little. Thus, when the display off time is not considered, these compensation methods will over-compensate. Thus, in these related approaches, the values stored in the storage unit or the memory are maintained or increase.

Compared to the aforementioned related approaches, the present disclosure considers the display off time DOT of the sub-pixels, and converts the display off time DOT into the stress reduction value SR or the compensation reduction value CR. Thus, the values stored in the storage unit 160 or the memory 200 decrease. The present disclosure can avoid overcompensation such that the present disclosure has a better compensation and the displaying effect can be better.

In some embodiments, the reduction unit 120 can merely convert the display off time DOT into the stress reduction value SR without converting the display off time DOT into the compensation reduction value CR. In some embodiments, the reduction unit 120 can merely convert the display off time DOT into the compensation reduction value CR without converting the display off time DOT into the stress reduction value SR. In some embodiments, the reduction unit 120 can convert the display off time DOT into the stress reduction value SR and the compensation reduction value CR.

Based on the descriptions above, in the present disclosure, a better compensation effect can be achieved, and the displaying effect can be better.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A display device, comprising:

a display panel; and a processor coupled to the display panel, wherein the processor is configured to generate first output data according to first input data and a first compensation value, generate a stress reduction value and a compensation reduction value according to the first input data, calculate a final stress value according to the first output data, at least one first operating factor, and the stress reduction value, calculate a second compensation value according to the final stress value and the compensation reduction value, and output second output data according to second input data, the second compensation value, and at least one second operating factor, wherein the display panel receives the second output data to display according to the second output data.

2. The display device of claim 1, further comprising:

a memory coupled to the processor and configured to store the final stress value.

3. A processor coupled to a display panel, wherein the processor is configured to generate first output data according to first input data and a first compensation value, generate a stress reduction value and a compensation reduction value according to the first input data, calculate a final stress value according to the first output data, at least one first operating factor, and the stress reduction value, calculate a second compensation value according to the final stress value and the compensation reduction value, and output second output data according to second input data, the second compensation value, and at least one second operating factor for the display panel to display according to the second output data.

4. The processor of claim 3, wherein the processor is further configured to convert the first input data into an original representation value of a region, multiply the original representation value with a scale to generate a final representation value, set a determination value of the region to be a start value when the final representation value is less than a threshold value, calculate a display off time when the determination value is kept at the start value, and convert the display off time into the stress reduction value according to a look-up table.

5. The processor of claim 3, wherein the processor is further configured to convert the first output data into a first stress value according to a look-up table, multiply the first stress value with the at least one first operating factor to generate a second stress value, and generate the final stress value according to the second stress value and the stress reduction value, wherein the final stress value is less than the second stress value.

6. The processor of claim 5, wherein the processor is further configured to add the second stress value and the stress reduction value to generate the final stress value when the stress reduction value is a negative value.

7. The processor of claim 5, wherein the processor is further configured to multiply the second stress value with the stress reduction value to generate the final stress value when the stress reduction value is a positive value less than 1.

8. The processor of claim 3, wherein the processor is further configured to convert the first input data into an original representation value of a region, multiply the original representation value with a scale to generate a final representation value, set a determination value of the region to be a start value when the final representation value is less than a threshold value, calculate a display off time when the determination value is kept at the start value, and convert the display off time into the compensation reduction value according to a look-up table.

9. The processor of claim 3, wherein the processor is further configured to convert the final stress value into a third compensation value, and generate the second compensation value according to the third compensation value and the compensation reduction value, wherein the second compensation value is less than the third compensation value.

10. The processor of claim 9, wherein the processor is further configured to add the third compensation value and the compensation reduction value to generate the second compensation value when the compensation reduction value is a negative value.

11. The processor of claim 9, wherein the processor is further configured to multiply the third compensation value with the compensation reduction value to generate the second compensation value when the compensation reduction value is a positive value less than 1.

12. An image processing method, comprising:

generating, by a processor, first output data according to first input data and a first compensation value;

generating, by the processor, a stress reduction value and a compensation reduction value according to the first input data;

calculating, by the processor, a final stress value according to the first output data, at least one first operating factor, and the stress reduction value;

calculating, by the processor, a second compensation value according to the final stress value and the compensation reduction value; and outputting, by the processor, second output data according to second input data, the second compensation value, and at least one second operating factor for a display panel to display.

13. The image processing method of claim 12, wherein generating, by the processor, the stress reduction value according to the first input data comprises:

converting, by the processor, the first input data into an original representation value of a region;

multiplying, by the processor, the original representation value with a scale to generate a final representation value;

setting, by the processor, a determination value of the region to be a start value when the final representation value is less than a threshold value;

calculating, by the processor, a display off time when the determination value is kept at the start value; and converting, by the processor, the display off time into the stress reduction value according to a look-up table.

14. The image processing method of claim 12, wherein calculating, by the processor, the final stress value according to the first output data, the at least one first operating factor, and the stress reduction value comprises:

converting, by the processor, the first output data into a first stress value according to a look-up table;

multiplying, by the processor, the first stress value with the at least one first operating factor to generate a second stress value; and generating, by the processor, the final stress value according to the second stress value and the stress reduction value, wherein the final stress value is less than the second stress value.

15. The image processing method of claim 14, wherein generating, by the processor, the final stress value according to the second stress value and the stress reduction value comprises:

adding, by the processor, the second stress value and the stress reduction value to generate the final stress value when the stress reduction value is a negative value.

16. The image processing method of claim 14, wherein generating, by the processor, the final stress value according to the second stress value and the stress reduction value comprises:

multiplying, by the processor, the second stress value with the stress reduction value to generate the final stress value when the stress reduction value is a positive value less than 1.

17. The image processing method of claim 12, wherein generating, by the processor, the compensation reduction value according to the first input data comprises:

converting, by the processor, the first input data into an original representation value of a region;

multiplying, by the processor, the original representation value with a scale to generate a final representation value;

setting, by the processor, a determination value of the region to be a start value when the final representation value is less than a threshold value;

calculating, by the processor, a display off time when the determination value is kept at the start value; and converting, by the processor, the display off time into the compensation reduction value according to a look-up table.

18. The image processing method of claim 12, wherein calculating, by the processor, the second compensation value according to the final stress value and the compensation reduction value comprises:

converting, by the processor, the final stress value into a third compensation value; and generating, by the processor, the second compensation value according to the third compensation value and the compensation reduction value, wherein the second compensation value is less than the third compensation value.

19. The image processing method of claim 18, wherein generating, by the processor, the second compensation value according to the third compensation value and the compensation reduction value comprises:

adding, by the processor, the third compensation value and the compensation reduction value to generate the second compensation value when the compensation reduction value is a negative value.

20. The image processing method of claim 18, wherein generating, by the processor, the second compensation value according to the third compensation value and the compensation reduction value comprises:

multiplying, by the processor, the third compensation value with the compensation reduction value to generate the second compensation value when the compensation reduction value is a positive value less than 1.

* * * * *